US005327858A

United States Patent [19]

Hausknecht

[11] Patent Number: 5,327,858

[45] Date of Patent: Jul. 12, 1994

[54] FLOW RESTRICTION CONTROLLED VARIABLE ENGINE VALVE SYSTEM

[76] Inventor: Louis A. Hausknecht, 1011 Sundance Dr., Miaminsburg, Ohio 45342

[21] Appl. No.: 102,147

[22] Filed: Aug. 4, 1993

Related U.S. Application Data

[63] Continuation-in-part of Ser. No. 951,017, Sep. 25, 1992, Pat. No. 5,233,951.

[51] Int. Cl.[5] ..... F01L 1/34; F01L 9/02

[52] U.S. Cl. ..... 123/90.12; 123/90.16

[58] Field of Search ..... 123/90.12, 90.13, 90.15, 123/90.16, 90.35, 90.48, 90.49

[56] References Cited

U.S. PATENT DOCUMENTS

| | | | |
|---|---|---|---|
| 1,580,077 | 4/1926 | Pilling | 123/90.12 |
| 1,696,984 | 1/1929 | Trbojevich | 123/90.12 |
| 1,876,735 | 9/1932 | Noble | 123/90.12 |
| 1,914,340 | 6/1933 | Holzwarth | 123/90.12 |
| 1,931,476 | 10/1933 | Hallett | 123/90.12 |
| 1,985,447 | 12/1934 | Grubbs | 123/90.36 |
| 1,994,223 | 3/1935 | Leveque | 123/90.12 |
| 2,011,864 | 8/1935 | Lundh | 123/90.12 |
| 2,019,252 | 10/1935 | Cottingham | 123/90.12 |
| 2,494,183 | 1/1950 | Lincoln | 123/90.12 |
| 2,602,434 | 7/1952 | Barnaby | 123/90.12 |
| 2,615,438 | 10/1952 | Tucker | 123/90.12 |
| 2,621,640 | 12/1952 | Reggio | 123/90.13 |
| 2,772,667 | 12/1956 | Nallinger | 123/90.43 |
| 2,785,666 | 3/1957 | Evans | 123/90.43 |
| 2,785,667 | 3/1957 | Miller | 123/90.16 |
| 2,813,521 | 11/1957 | Sampietro | 123/90.43 |
| 2,815,012 | 12/1957 | Sampietro | 123/90.43 |
| 2,829,628 | 4/1958 | Smiltneek | 123/90.12 |
| 2,954,017 | 9/1960 | Forstner | 123/90.16 |
| 3,261,338 | 7/1966 | Arutunoff et al. | 123/90.15 |
| 3,385,274 | 5/1968 | Shunta et al. | 123/90.16 |
| 3,405,699 | 10/1968 | Laas | 123/90.12 |
| 3,413,965 | 12/1968 | Gavasso | 123/90.16 |
| 3,490,423 | 1/1970 | Shunta et al. | 123/90.16 |
| 3,518,976 | 7/1970 | Thuesen | 123/90.16 |
| 3,612,015 | 10/1971 | Hausknecht | 123/90.12 |
| 3,727,595 | 4/1973 | Links | 123/90.12 |
| 4,020,806 | 5/1977 | Aoyama et al. | 123/90.55 |
| 4,077,369 | 3/1978 | Buehner | 123/90.16 |
| 4,134,371 | 1/1979 | Hausknecht | 123/90.43 |
| 4,153,016 | 5/1979 | Hausknecht | 123/90.15 |
| 4,164,917 | 8/1979 | Glasson | 123/97 |
| 4,337,739 | 7/1982 | Jordan | 123/198 |
| 4,407,241 | 10/1983 | Butler et al. | 123/90.16 |
| 4,483,283 | 11/1984 | Hausknecht | 123/90.46 |
| 4,509,467 | 4/1985 | Arai et al. | 123/90.16 |
| 4,796,573 | 1/1989 | Wakeman et al. | 123/90.16 |
| 4,873,949 | 10/1989 | Fujiyoshi et al. | 123/90.12 |
| 5,052,235 | 3/1985 | Mitchell | 123/90.17 |
| 5,161,500 | 11/1992 | Kubis et al. | 123/321 |
| 5,163,389 | 11/1992 | Fujikawa et al. | 123/90.16 |
| 5,165,369 | 11/1992 | Rembold et al. | 123/90.12 |
| 5,233,951 | 8/1993 | Hausknecht | 123/90.16 |

FOREIGN PATENT DOCUMENTS 1399813 7/1975 United Kingdom .

OTHER PUBLICATIONS

"Lost-Motion Mechanism Varies Valve Timing," 1984 Society of Automotive Engineers, Inc.; Aug. 1984.
Ward's Engine and Vehicle Technology Update, 1991
Ward's Communication, vol. 17, No. 23; Dec. 1, 1991.

*Primary Examiner*—E. Rollins Cross
*Assistant Examiner*—Weilun Lo
*Attorney, Agent, or Firm*—Reese Taylor

[57] ABSTRACT

A flow restriction controlled variable engine valve system includes a housing slidably mounted in the engine housing and movable therein in response to movement of an engine cam. A sleeve is telescoped within the housing in fluid communication with the engine oil supply and a portion of the housing. A control rod is carried by the sleeve and projects into the aforementioned portion of the housing to restrict fluid flow therebetween. A check valve is carried by the housing and closes off the fluid communication between the housing and the sleeve after movement of the housing in response to cam movement to lock up the sleeve and housing for further movement together with the sleeve being operatively connected to the valve to open it upon further movement of the locked up sleeve and housing. A velocity reduction spring is interposed between the sleeve and the valve.

13 Claims, 8 Drawing Sheets

FLOW RESTRICTION CONTROLLED VARIABLE ENGINE VALVE SYSTEM

RELATED PATENT APPLICATIONS

This application is a continuation-in-part of Applicant's earlier filed application, Ser. No. 951,017, now U.S. Pat. No. 5,233,951, filed Sep. 25, 1992.

BACKGROUND OF THE INVENTION

This invention relates in general to the intake and exhaust valves of internal combustion engines and relates in particular to the control and timing of the valves so as to vary their timing in response to varying operational speeds of the engine.

DESCRIPTION OF THE PRIOR ART

This invention is generally intended to reduce automotive engine fuel consumption and improve efficiency. It is well settled in the art that there is great potential for variable valving timing for improving performance and reducing emissions in internal combustion engines by controlling and varying the valve timing in response to varying engine operational speeds. Conventional cam profiles have been a compromise between optimum low speed/low load and high speed/-high load efficiency requirements. However, to obtain maximum efficiency over the entire engine operating range, it is desirable to be able to vary the valve timing with speed and load.

The simplest forms of such timing systems are phase shifters which move the opening and closing of engine valves to reduce overlap, but do not change the duration of the cam, which is a fixed event.

More advanced variable timing systems vary both the phasing and the length of the cam event, but are relatively complex and expensive.

The prior art also includes systems which split the existing camshaft into sections, one for each cylinder, and are hollow cored and supported on their own bearings in modified housings. A drive shaft using the original drive flange configuration passes through the center of these hollow cams and drives each of the short camshafts. A drive shaft which runs in its bearing housings and which can be moved to produce an offset in the drive shaft center line relative to the camshaft center line is utilized. This relative offset enables the velocity of force imparted to the cams to be varied and, in that fashion, individual cams can be accelerated or decelerated during a single cam revolution. As engine speeds and loads increase, the center lines of the drive shaft and camshaft converge, thereby purportedly reducing valve train stress.

The engine valve timing, either intake or exhaust or both, can thus be varied at maximum engine power to provide different valve timing parameters as engine speed and load rises. Such systems are applicable to both double overhead cam and single overhead cam engines.

It is thus well-known in the art that passive, lost motion mechanisms for varying timings are desirable. Those currently contemplated do tend, however, to be relatively complex and it is believed that they can be greatly improved upon and simplified.

In that regard, simplification has been achieved with high leakage lifter designs, but they lack the ability to provide the needed range of valve timing variation without high valve seating velocities. These designs never solidify hydraulically to transmit high fidelity motion from the cam to the valve. The continuous leakage further increases the high valve velocities already present on the cam profile, off the closing ramps, which is where these lifters require the valves to seat at undesirably high velocities.

SUMMARY OF THE INVENTION

It has thus been discovered that the desirable features of variable valve timing can be obtained by producing a flow restriction controlled lifter which varies the amount of engine valve lost motion inversely to engine speed.

With this valve lifter, as the engine speed increases, the flow restriction increasingly hinders the flow of oil past the unseated check valve. This causes the check valve seating and lifter lockup to occur sooner, lengthening the engine valve open event.

It has been found that this object can be attained by providing a restrictor member in the form of a control rod which restricts flow and, by varying the diameter and weight of the rod, or putting a flat or a groove on the rod, or using a hollow control rod with a metering orifice, or by sizing the check valve opening, or by sizing the hydraulic lifter plunger feed orifice, resistance to check valve seating can be varied to vary the engine speed at which lifter lockup occurs to eliminate the high speed, high velocity valve closing normally present in high leakage lifters.

It has been further found that this operation can be facilitated by utilizing multiple spring washers or a velocity reduction spring so as to provide beneficial results to valve seating from idle through the speed of rapid lockup.

The velocity reduction spring reduces valve opening and closing velocities due to a spring rate differential between it and the engine valve spring. In operation, the velocity reduction spring must be slightly compressed beyond its preload value, to overcome the resistance of the engine valve spring. When this occurs, the engine valve will begin to open. This is done, however, at a slower rate than would be possible without the velocity reduction spring, as some camshaft lift is diverted to the velocity reduction spring. Upon engine valve closing, there is also a reduction in engine valve velocity. The interaction process between the velocity reduction spring and the engine valve spring and valve assembly reverses. Since the velocity reduction spring possesses stored potential energy, it will delay valve closing until the velocity reduction spring expends energy above its original preload value.

As the engine speed increases, the valve lifter and consequently the engine valve will operate on an increasingly lower velocity portion of the camshaft profile and finally lifter lockup occurs.

Accordingly, production of an improved flow restriction controlled hydraulic variable engine valve actuation system becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
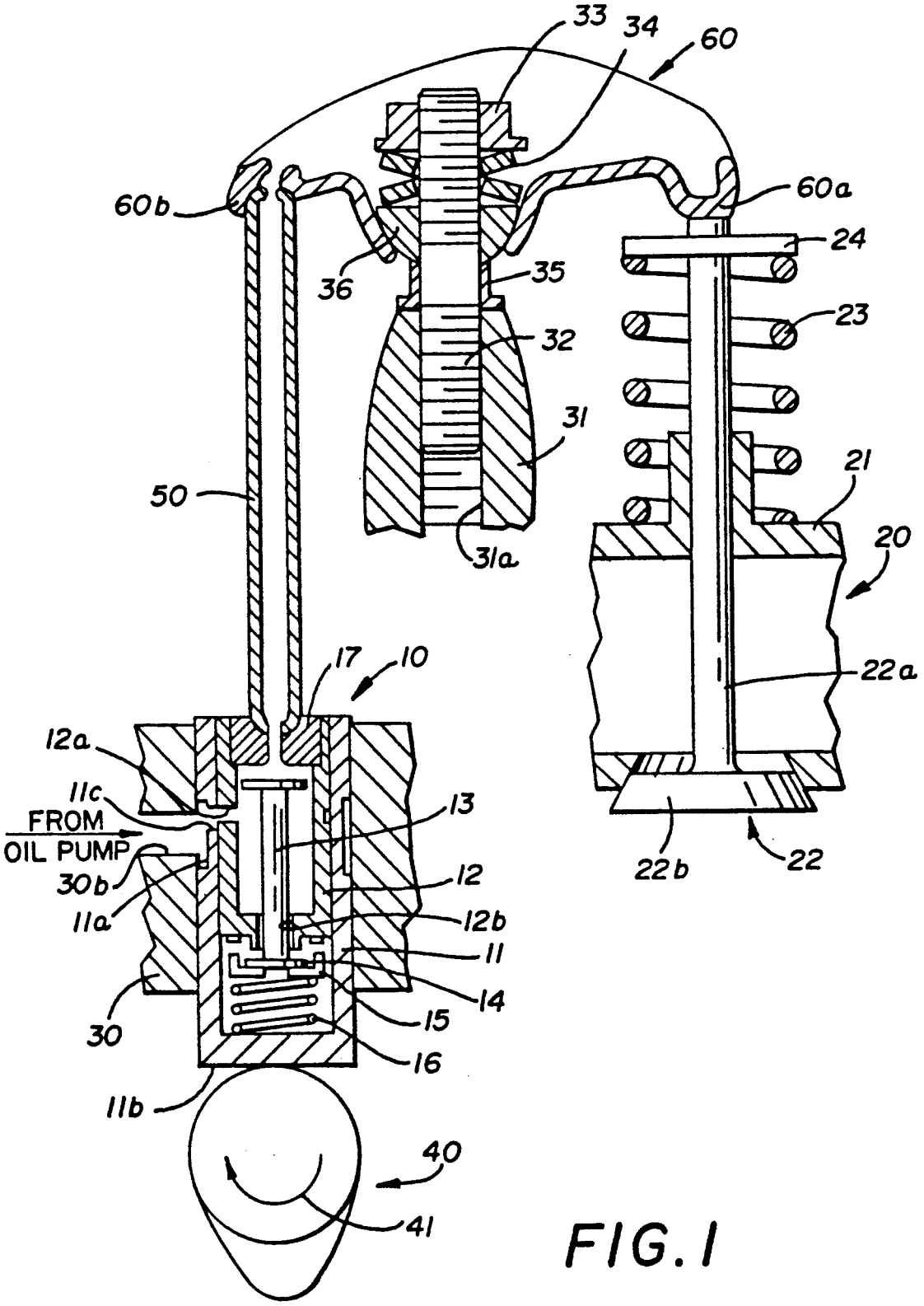
FIG. 1 is a sectional view, partially schematic, showing the preferred form of the invention prior to operation.

Referring first, then, to FIG. 1 of the drawings, it will be assumed that the invention in question is employed with an internal combustion engine employing a crankshaft, camshaft, an engine oil pump and the other usual components of such an engine. As will be noted from the following description and a review of the drawings, the basic principle of this invention is applicable to a number of different valve train arrangements with only slight modifications in structure and no modifications in principle of operation. Also, only one valve is illustrated in the drawings depicting the various forms of the invention for simplicity of illustration, it being understood that one of ordinary skill in this art could readily adapt this to a conventional engine.

Referring then to FIG. 1 of the drawings, it will be noted that the improved control mechanism, generally indicated by the numeral 10, is located in the engine housing 30 above the cam 40. The cam 40 is a conventional cam mounted on a conventional camshaft (not shown) and rotatable in the direction of the arrow 41.

As can be seen, an opening is formed in the engine housing 30 to slidingly receive a main control housing 11 which is, as illustrated, a cylindrical member having a closed bottom wall 11*b* and an open top with the bottom wall 11*b* resting on the cam 40 and with a peripheral recessed area 11*a* and a radial bore 11*c*.

Telescoped within the housing 11 is a sleeve 12 which is also a generally cylindrical member having a bottom wall and an open top and with its cylindrical side wall having a through radial bore 12*a* which communicates with the bore 11*c* in the main control housing 11 and the bore 30*b* in the engine housing 30 so as to be in fluid communication with the engine oil pump. The sleeve 12 also has an axially extending opening 12*b* in its bottom wall which is in fluid communication with the lower portion of the housing 11 above bottom wall 11*b* for purposes which will be described.

A restrictor control member 13, as illustrated in FIG. 1, takes the form of a nail-shaped rod which is telescoped within the sleeve 12 and projects through the opening 12*b* in the bottom thereof. The open top of sleeve 12 is also closed off by a rod seat member 17 which is contoured in its top surface suitably to receive the push rod 50.

Received within the lower portion of the housing 11 beneath sleeve 12 is a coil spring 16, one end of which rests on the bottom wall 11*b* of housing 11 and the other end of which receives a cup-shaped member 15 and a check valve disc 14.

Still referring to FIG. 1 of the drawings, it will be seen that a rocker arm 60 is mounted on another portion 31 of the engine housing and is received on a stud 32, which is threaded into the housing opening 31*a* at its bottom end, and receives a bushing 35, a resilient member, taking the form in the drawing of a Belleville spring 34, and a threaded cap 33 on its upper end to secure the spring 34 in place against fulcrum 36.

The rocker arm 60 has opposed ends 60*a* and 60*b* with the end 60*b* engaging the top end of push rod 50 and the end 60*a* engaging the top of valve stem 22*a*.

To that end, the engine valve assembly 20 includes a housing 21 and an engine valve 22 which includes the valve stem 22*a* and a valve head 22*b*. The conventional valve spring 23 is received between housing 21 and the spring retainer 24 with the top end of the valve stem being in contact with the end 60*a* of the rocker arm 60, as previously noted, so that downward movement of end 60*a* of rocker arm 60 will overcome the force of spring 23 and cause the valve 22 to open.

Figure 2:
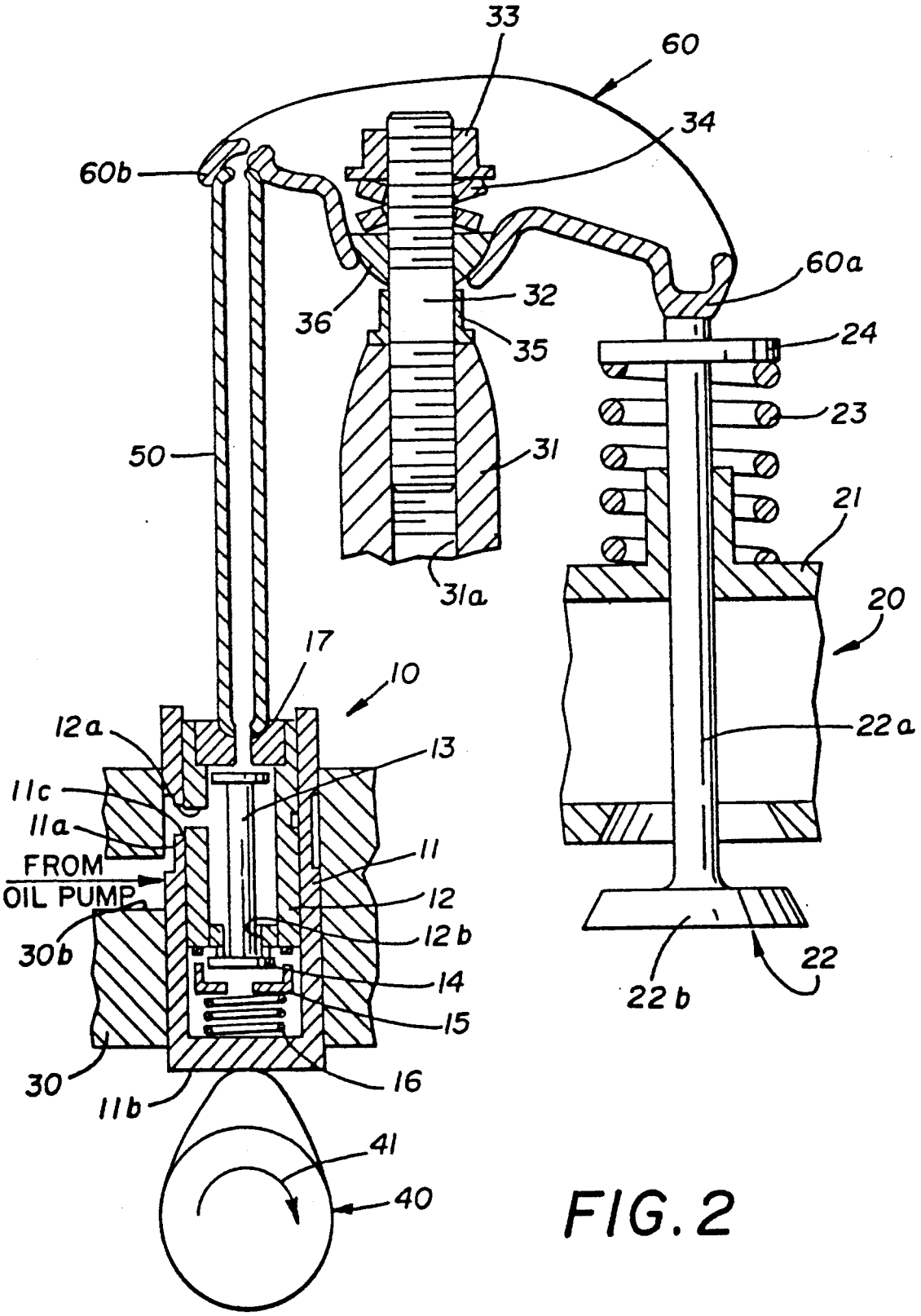
FIG. 2 is a view similar to FIG. 1 showing the preferred form of the invention during opening of the valve.

In operation of the form of the invention illustrated in FIGS. 1 and 2 of the drawings, it will be noted that, as the cam 40 rotates, it will force housing 11 upwardly, as can be readily seen by comparing FIGS. 1 and 2 of the drawings. As oil under pressure enters through the openings 30*b*, 11*c* and 12*a*, in the FIG. 1 position, some of that oil will escape to the lower portion of the housing 11 through the aperture 12*b* since the periphery of control member 13 is spaced from the inner wall thereof. As the cam 40 moves in the direction of the arrow 41, the housing 11 is driven upwardly compressing spring 16, thus reducing the space between the bottom of the sleeve 12 and the bottom wall 11*b* of the housing 11. At some point, the compression of the oil trapped in that area forces the check valve disc 14 upward, taking the control member 13 with it and closing off the axial opening 12*b*. The result, of course, is a lockup and a further result is that the push rod 50 is driven upwardly to pivot the rocker arm 60 which, in turn, depresses the valve stem 22*a*, overcomes the force of spring 23 and opens the valve 22, as can be seen in FIG. 2 of the drawings.

It will be noted that the point at which the system locks up and causes the valve 22 to open can be varied by varying either the weight or the diameter of the control member 13. Thus, the smaller the diameter of the rod, the slower the upward movement until the device locks up, inasmuch as the thinner it is, the more oil may escape through the aperture 12*b* before lockup. A similar result may be achieved by increasing the weight of control member 13.

On the return stroke, at high speed, the control member 13 helps open the check valve disc, since its inertia and weight moves it downwardly to reopen aperture 12*b*.

Figure 3:
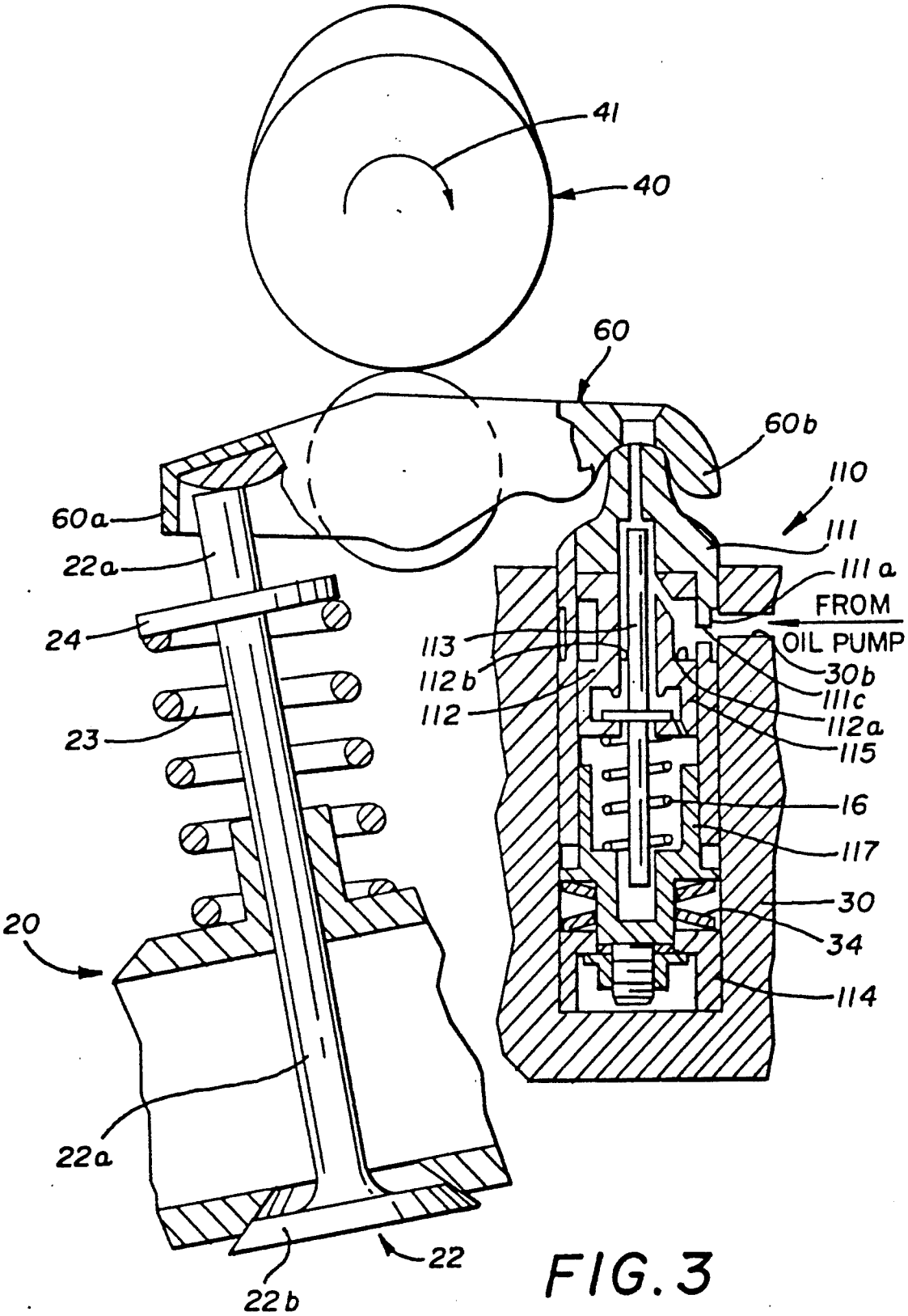
FIG. 3 is a view of a modified form of the invention employed with an overhead cam engine with a rocker arm.

Referring next, then, to FIG. 3 of the drawings, it will be seen that similar, unmodified components are identified by the same numerals, while the modified portions are designated by like numbers in the 100 series. This form of the invention illustrates the inventive concept employed with an overhead cam engine with a rocker arm. The valve assembly 20 and valve 22 are identical in structure and the cam 40 and its function is also quite similar. Here, however, the rocker arm 60 is directly engaged with the control mechanism 110 rather than through the medium of a push rod.

As can be seen, most of the structure is similar, except for the fact that the housing 111 moves in the reverse direction and the top of housing 111 is in direct engagement with the rocker arm 60. The control member 113 again, however, controls movement of the fluid out of the chamber formed by sleeve 112 and spring seat member 117 through the opening **112*b* with the spring 16 being interposed between spring seat 117 and cup 115 and with the Belleville spring or resilient member 34 being disposed between the seat 117 and the threaded cap 33 equivalent 114**.

Figure 4:
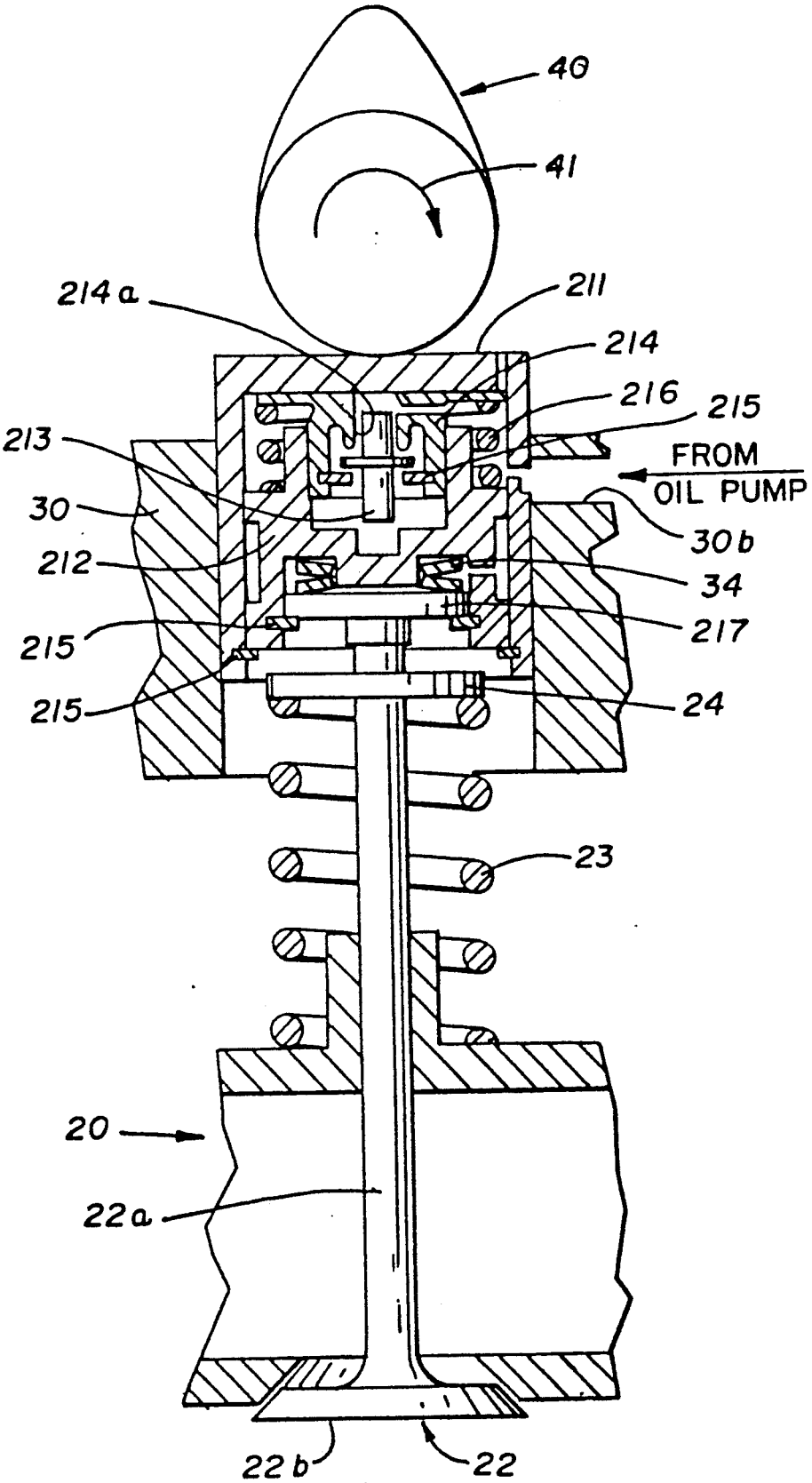
FIG. 4 is a further modified view of the invention showing the principal components thereof with a direct acting overhead cam engine.

Reference to FIG. 4 of the drawings illustrates the same inventive concept embodied in a direct acting overhead cam engine, wherein similar parts are identified by the same numbers and modified components are identified by the similar numbers in the 200 series. Here, again, of course, some modification occurs in that there is no rocker arm 60 and no push rod 50 with the cam 40 acting directly on the main housing 211. Again, a coil spring 216 is interposed between the sleeve 212 and the main housing 211 through the equivalent to the check valve disc support 214, and the cup-shaped member 15,115 is replaced by upper split ring 215 with the remaining split rings 215 performing a stop function. The Belleville spring 34 is interposed between the seat 217 and the sleeve 212.

Again, restrictor control member 213 controls fluid flow through axial bore **214*a***.

Figure 5:
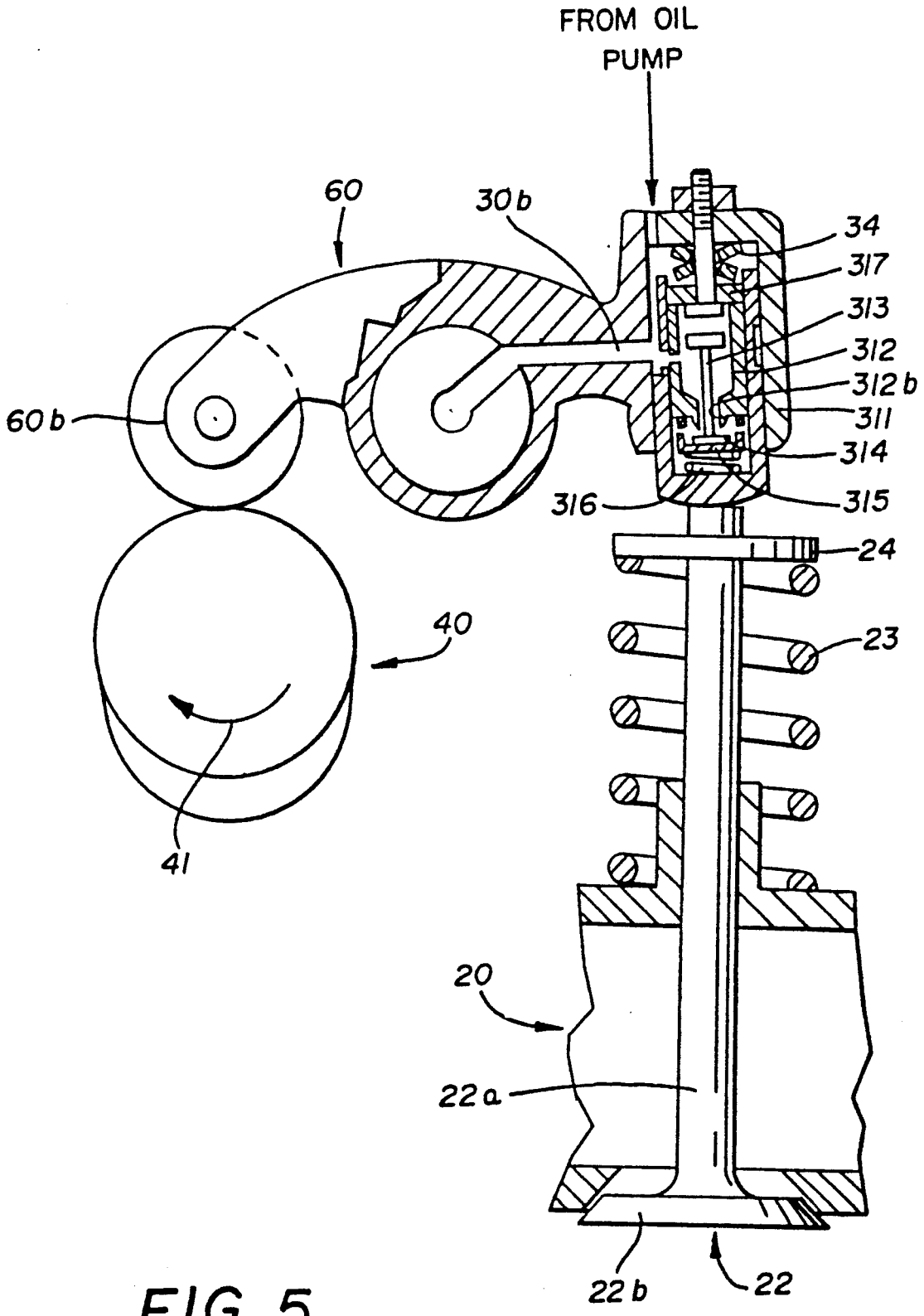
FIG. 5 is a view similar to FIG. 1 showing a further modified view of the invention showing the improved apparatus employed with an overhead cam engine with a rocker arm.

Referring next to FIG. 5 of the drawings, it will be seen that the invention is illustrated in connection with an overhead cam engine with a rocker arm 60 and wherein, again, there is no push rod. Modified components have been identified by like numerals in the 300 series, and it will be noted that the Belleville spring 34 is interposed here between the housing 311 and the seat 317. Again, restrictor control member 313 restricts flow through bore **312*b***.

Figure 6:
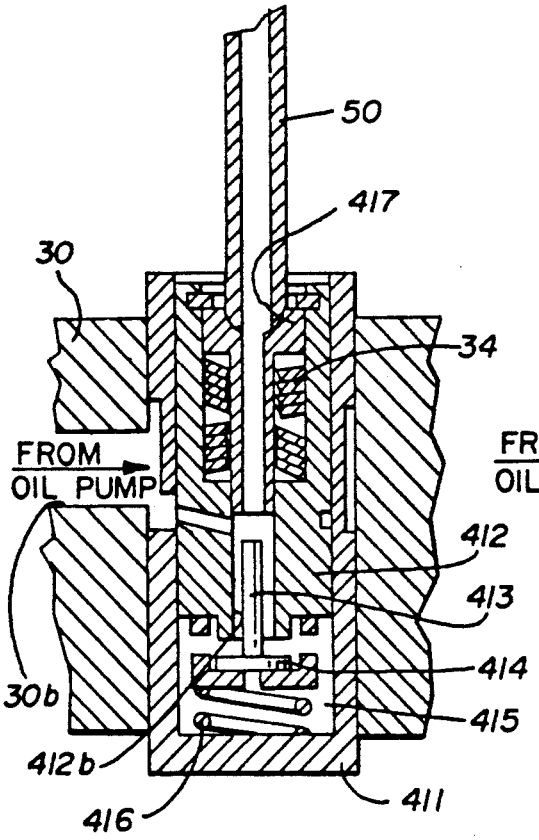
FIG. 6 is a still further, more compact version of the invention.

Referring to FIG. 6, a very compact version of the invention is illustrated, wherein the Belleville spring 34 is disposed between the rod seat member 417 and the sleeve 412 and restrictor control member 413 controls flow through bore **412*b* until lockup. For simplicity, cam 40 has been omitted in this drawing figure, but it will be understood that the housing 411 is moved in response to such a cam. Otherwise, this form of the invention closely resembles that of FIG. 1** of the drawings.

Figure 7:
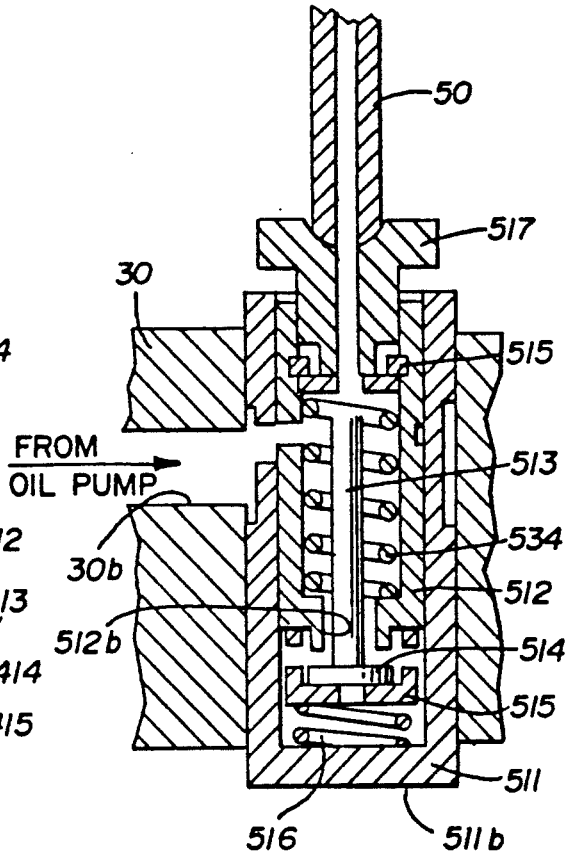
FIG. 7 is a partial sectional view showing a still further modified form of the invention with a different variable resistance member.
Figure 8:
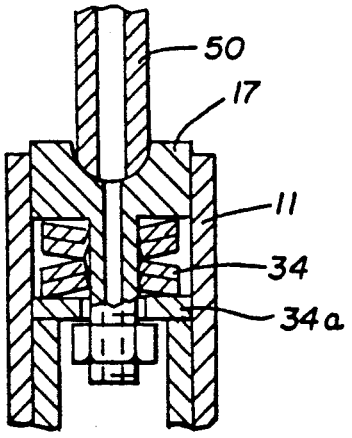
FIGS. 8 and 9 are partial sectional views showing further minor modifications to the basic invention.
Figure 9:
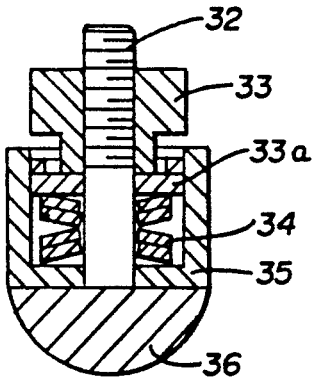

FIGS. 7, 8 and 9 illustrate further modifications of the invention.

Thus, in FIG. 7, the Belleville spring has been replaced by a coil spring 534 received within housing 512, and coil spring 516 is disposed beneath cup-shaped member 515 and the bottom wall **511*b* of main housing 511. Again, housing 511 is moved upwardly by a cam (not shown) acting against bottom wall 511*b* and push rod 50 engages a rocker arm (not shown). It will be apparent that restrictor control member 513 restricts flow through bore 512*b*** as described above.

FIG. 8 illustrates a modification of FIG. 1 wherein main housing 11 is simply elongated to incorporate the Belleville spring assembly 34 between rod seat member 17 and retainer **34*a* and provide a more compact assembly. Thus, the spring 34 has been relocated from adjacent the rocker arm 60 to within the housing 11**.

In FIG. 9, provision is made for the elimination of the bushing, such as 35 of FIG. 1, by trapping the resilient member 34 between cap 33 and plate **33*a* and housing 35**.

Figure 10:
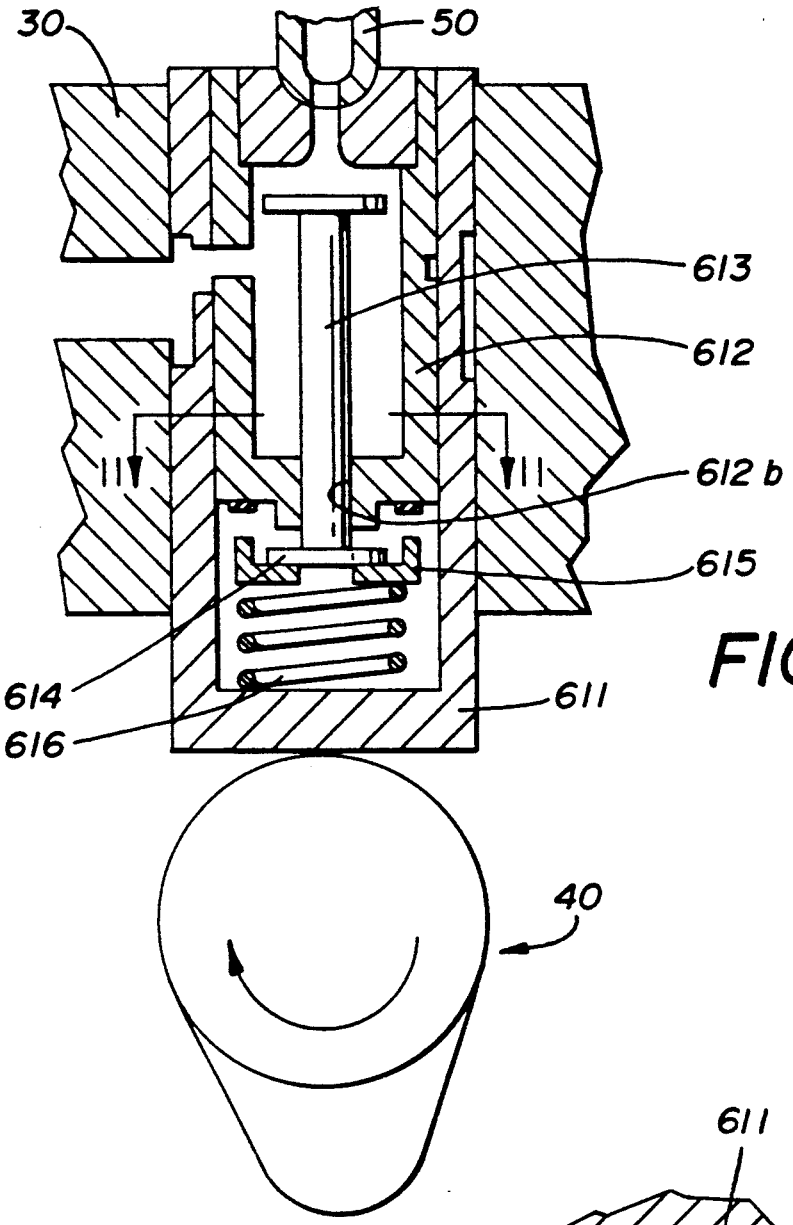
FIG. 10 is a partial sectional view showing a modified form of restrictor member.
Figure 11:
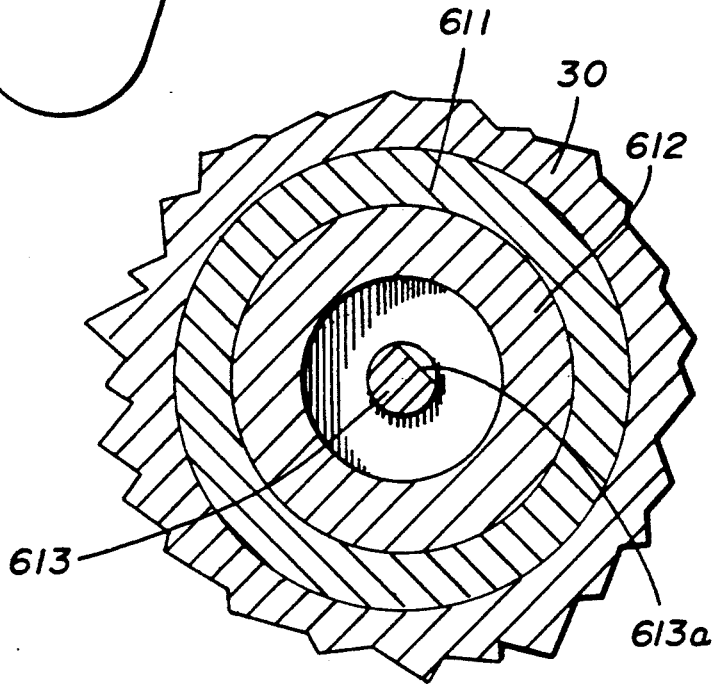
FIG. 11 is a sectional view taken along the line 11—11 of FIG. 10.

Thus, referring to FIGS. 10 and 11 of the drawings, it will be seen that the restrictor control member 613 resembles the rod 13 of FIG. 1 but is provided with a flat or groove **613*a* which facilitates the escape of oil through opening 612*b*** and thus delaying lockup and valve opening.

Figure 12:
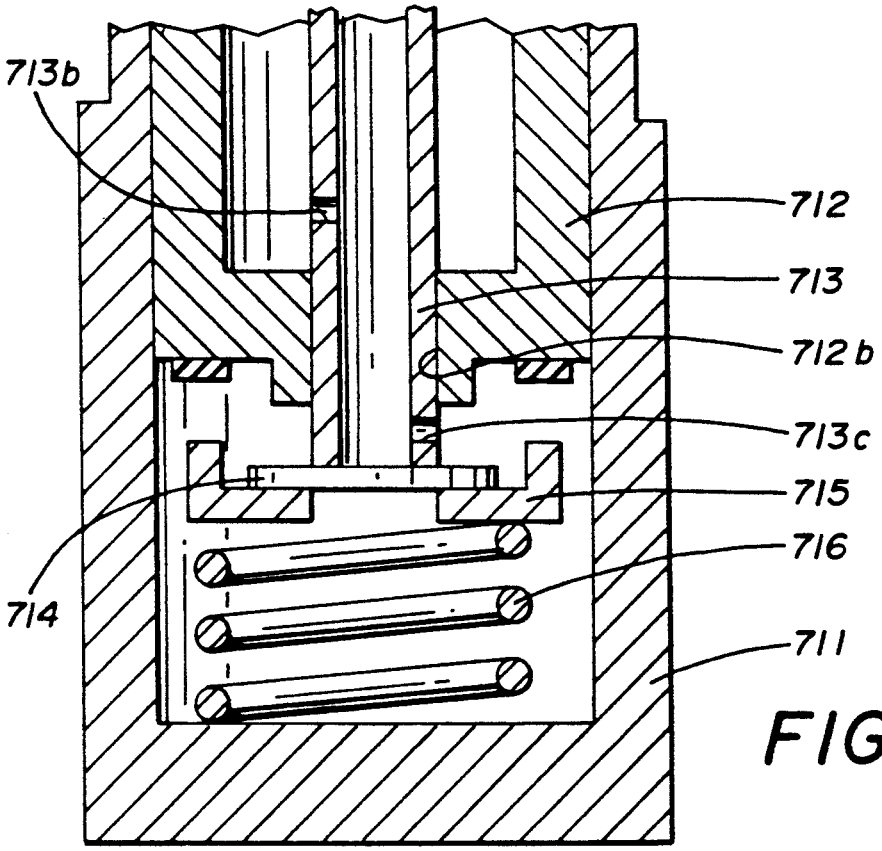
FIGS. 12 and 13 are partial sectional views showing a further modified form of restrictor member.
Figure 13:
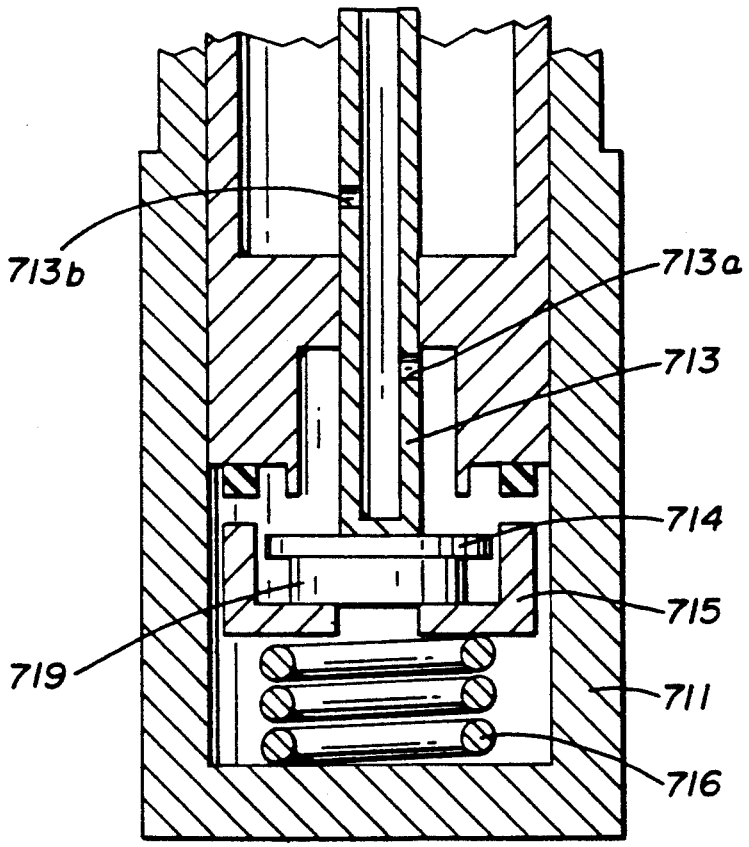

Similarly, FIGS. 12 and 13 illustrate the use of a hollow restrictor control member as exemplified by rod 713. In FIG. 12 it will be seen that rod 713 has two radial ports, **713*a* and 713*b*. In this fashion, lowermost port 713*a* will be closed off prior to seating of the check valve. The positioning of port 713*a*** will thus affect a measure of control to the timing of the valve event.

Also, FIG. 13 illustrates the hollow restrictor control member of FIG. 12 used with a shim 719 placed under the disc 714 to position the port **713*a* before hydraulically caused movement of it occurs. It will thus be apparent that a thicker shim will cause earlier seating of the check valve inasmuch as it will result in earlier closing off of the port. Also, shim 719 can be fabricated of highly heat sensitive material. In that fashion, as the oil heats up, the shim will expand raising rod 713 and placing the port 713*a*** closer to closure. At colder temperature the reverse will occur.

It will be noted that, in all instances, it is important that the velocity reduction member of Belleville spring illustrated in the drawings or, for that matter, the spring 534 illustrated in FIG. 7 of the drawings are interposed between the top of the valve stem and the lifter or sleeve in all forms of the invention.

While a full and complete description of the invention has been set forth in accordance with the dictates of the Patent Statutes, it should be understood that modifications could be resorted to without departing from the spirit hereof or the scope of the appended claims.

Thus, while a disc type check valve is illustrated, other types of check valves could be employed if desired. Also, while the rod-like restrictor control member 13 is shown as a solid, nail-like member, it could be modified if desired.

What is claimed is:

1. Means for variably controlling an operational event of an engine valve in internal combustion engines, comprising:

a) an elongate housing;

b) an elongate sleeve telescoped within said housing in fluid communication with an engine oil pump and having a through opening to a lower portion of said housing;

c) a restrictor control member telescoped within said sleeve and projecting into said opening in said sleeve;

d) a check valve disposed within said housing beneath said sleeve and said restrictor member and movable in response to a movement of an engine cam to move said restrictor control member, close off said opening in said sleeve and open the engine valve; and e) said restrictor control member including a cylindrical member having a periphery with an axially extending reduced diameter area.

2. The means of claim 1 wherein said check valve includes a disc, movable into and out of covering relationship with said opening in said sleeve.

3. The means of claim 1 wherein engine valve velocity reduction means is disposed in operative relationship with said sleeve and between said sleeve and the engine valve.

4. Means for variably controlling an operational event of an engine valve in internal combustion engines, comprising:

a) an elongate housing;

b) an elongate sleeve telescoped within said housing in fluid communication with an engine oil pump and having a through opening to a lower portion of said housing;

c) a restrictor control member telescoped within said sleeve and projecting into said opening in said sleeve;

d) a check valve disposed within said housing beneath said sleeve and said restrictor member and movable in response to a movement of an engine cam to move said restrictor control member, close off said opening in said sleeve and open the engine valve; and e) said restrictor control member including a hollow cylindrical member having a sidewall with at least two radially extending, axially spaced through ports.

5. The means of claim 4 wherein said check valve includes a disc, movable into and out of covering relationship with said opening in said sleeve.

6. The means of claim 4 wherein engine valve velocity reduction means is disposed in operative relationship with said sleeve and between said sleeve and the engine valve.

7. The means of claim 5 wherein shim means are disposed on said disc.

8. The means of claim 7 wherein said shim means are fabricated of heat sensitive material.

9. The means of claim 1 or 4 wherein velocity reduction means are disposed between said sleeve and the engine valve.

10. The means of claim 1 or 4 further including a rocker arm operatively interconnecting said sleeve and the engine valve.

11. The means of claim 1 or 4 wherein said housing comprises a cylindrical member having a closed bottom end; said bottom end engaging the cam.

12. The means of claim 10 further including a push rod operatively interconnecting said sleeve and said rocker arm.

13. The means of claim 1 or 4 further including a spring disposed within said housing between said check valve and a closed bottom end of said housing.

* * * * *